US006084225A

United States Patent [19]

Schmitt

[11] Patent Number: 6,084,225

[45] Date of Patent: Jul. 4, 2000

[54] RF INDUCTION COIL

[75] Inventor: Philip Schmitt, Central Islip, N.Y.

[73] Assignee: The Lepel Corporation, Edgewood, N.Y.

[21] Appl. No.: 09/313,839

[22] Filed: May 17, 1999

[51] Int. Cl.[7] ..... H05B 6/40

[52] U.S. Cl. ..... 219/672; 219/676; 219/670; 219/635; 219/674; 336/198

[58] Field of Search ..... 219/672, 674, 219/676, 670, 635; 336/198

[56] References Cited

U.S. PATENT DOCUMENTS

| | | | |
|---|---|---|---|
| 3,648,005 | 3/1972 | Rudd | 219/613 |
| 4,340,038 | 7/1982 | McKean | 219/670 |
| 4,371,768 | 2/1983 | Pozna | 219/633 |
| 4,584,449 | 4/1986 | Timmons | 219/676 |
| 4,673,781 | 6/1987 | Nuns et al. | 219/670 |
| 4,704,509 | 11/1987 | Hilmersson et al. | 219/670 |
| 5,713,069 | 1/1998 | Kato | 219/619 |

OTHER PUBLICATIONS

Article, entitled "Induction Coil Design For Getter Flashing", Getters Corporation of America, E.M. Palsha, pp. 2–7 (with two pages of drawings).

*Primary Examiner*—Philip H. Leung
*Attorney, Agent, or Firm*—Seidel, Gonda, Lavorgna & Monaco, PC

[57] ABSTRACT

A getter heating coil assembly producing a focused magnetic field for heating objects in close proximity to the coil assembly. The coil assembly comprises electrical conductors wound on a coil bobbin, the coil bobbin having a central spindle around which the conductors are wound. The wound bobbin is assembled with a magnetic field concentrator, said field concentrator having a central core extending from a base, and a side wall extending from the base to enclose the wound bobbin. The central core of the field concentrator fits within the spindle on the bobbin and extends through it. The coil bobbin remains exposed on one side for emission of focused electromagnetic energy when alternating current is supplied to the coil windings. A button of high magnetic permeability material may be attached to the field concentrator for focusing the emitted electromagnetic energy toward the center of the coil.

6 Claims, 5 Drawing Sheets

RF INDUCTION COIL

FIELD OF THE INVENTION

The present invention relates to the field of induction heating, particularly highly focused induction heating of small items such as television picture tube getters and the like.

BACKGROUND OF THE INVENTION

Industrial products continue to be made smaller, requiring ever more precise and efficient processes to be developed to replace larger, less highly engineered equipment and processes used in the past. Higher efficiency leads directly to lower operating costs, which are demanded by manufacturers and customers alike. Induction heating of industrial parts and products is subject to these demands and more advanced and efficient techniques for induction heating of metals are being created.

Old methods and apparatus for induction heating of small parts must be replaced with more precise and efficient equipment. A need has arisen for a new induction heating coil design for heating various materials in which a typical arrangement is heating a discrete object located behind a non-conductive, non-metallic barrier. An example of one item requiring precise induction heating is a barium getter behind a glass tube, such as the picture tube in a television. The induction heating of such devices requires precision heating to high temperatures while shielding nearby elements from the effects of high energy electromagnetic fields. Existing heating coils tend to emit wide and unfocused magnetic fields that heat elements not requiring heating, causing unwanted damage and production delays.

SUMMARY OF THE INVENTION

The present invention is an induction heating coil assembly for precision, efficient heating of industrial materials. The invention comprises a coil former bobbin around which is wound copper tubing, solid wire, stranded wire or Litz wire for conducting electrical current to produce a high energy magnetic field in operation. The wound bobbin is assembled with a magnetic field concentrator that encloses most of the coil within a high magnetic permeability material. The field concentrator remains open on one side to emit a high energy magnetic field for induction heating of a nearby heating target element. In order to force the emitted field to concentrate towards the center of the target field, a ferrite knob or button may be assembled on to the central core of the field concentrator, extending in the direction of the heating target.

The heating coil may be water-cooled for very high temperature operation. In such an application, copper tubing is normally employed for the coil turns on the bobbin.

The field concentrator offers a lower magnetic resistance than air. Thus, on the sides of the coil enclosed by the concentrator, the magnetic field produced by the coil tends to remain confined within the field concentrator itself, isolating the coil's surroundings from the high-energy field. The field is emitted principally from the unconfined side of the coil in the desired direction only. The ferrite button that may be affixed to the central core of the field concentrator tends to pull the magnetic field toward the center of the emitting area of the coil, further focusing the electromagnetic heating energy.

BRIEF DESCRIPTION OF THE DRAWINGS

For the purpose of illustrating the invention, wherein like reference numerals indicate like elements, there is shown in the drawings a form which is presently preferred; it being understood, however, that this invention is not limited to the precise arrangements and instrumentalities shown.

DESCRIPTION OF THE INVENTION

The invention is an induction heating coil assembly for focusing an intense electromagnetic field onto a target element while protecting surrounding elements from accidental induction heating. In various embodiments, the invention may comprise combinations of a coil former bobbin, windings on the bobbin with wire leads extending out of the coil for connection to a power supply, a magnetic field concentrator into which the wound coil bobbin is assembled, and a ferrite button that may be affixed to the magnetic field concentrator to aid in focusing the emitted magnetic field toward the center of the target.

The following description is directed to the presently preferred embodiment of the invention, though variations may be incorporated while retaining the benefits of the invention.

Figure 1:
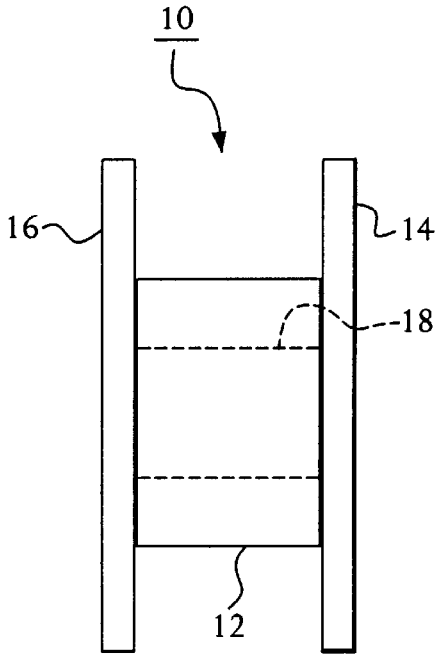
FIG. 1 is an elevation view of a coil winding bobbin.

Referring to FIG. 1, the coil assembly comprises a coil former bobbin 10. The bobbin 10 comprises a center spindle 12 around which conductors are wound to form a coil. At each end of the spindle 12 are flanges 14, 16 for restricting the coil windings within the dimension of the spindle 12. There is a hollow bore 18 through the center of the bobbin for assembling the bobbin with the magnetic field concentrator, described below. The coil former bobbin may be fabricated from one of various non-conductive materials, such as plastic, wood, or fiberglass.

Figure 2:
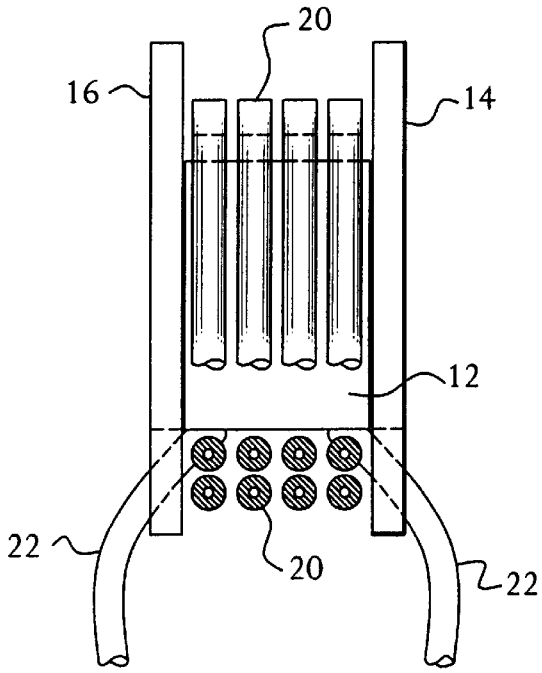
FIG. 2 is an elevation and partial cutaway view of a coil winding bobbin with conductive tubing wound on the bobbin.

Referring to FIG. 2, the coil former bobbin serves as a solid body around which the windings of the coil are placed. A coil winding of electrical conductor 20 is illustrated in FIG. 2. The conductor 20 shown in FIG. 2 is hollow conductive tubing (shown in partial cutaway). Such tubing is used when the electrical power employed to create the magnetic field is of such magnitude that the coil temperature could rise to damaging levels. The hollow tubing may have water or other cooling fluid passed through it during operation to carry away the heat generated by the induction heating function.

Various types of electrical conductor may be employed in an induction coil of the present invention. Windings comprising solid wire, stranded wire or Litz wire may also be used if conductor cooling will not be necessary in a particular use of the invention. The term "conductor" in this description is used to refer to the winding material without regard to its specific embodiment. The gauge of the conductor is determined by the particular heating purpose and operating parameters of the coil.

The conductor chosen for the coil is dependant upon several factors including frequency of operation, coil current, and the duty cycle required to meet the requirements of the heating task. The frequency determines the effective current penetration in the conductor and relates directly to the conductor loss. Several techniques can be used to size the conductors with respect to frequency. For instance, in Litz wire coils, the diameter of the conductors is made smaller with increasing frequency of operation.

The current is important due to losses in the wire. A duty cycle technique can allow more instantaneous current to pass through a conductor for a short period of time. As the duty cycle approaches a continuous duty time, however, the conductor size must be increased or the current must be reduced. At a certain level of dissipation, water cooling may be required. The typical method of cooling the coil is to use copper tubing for the conductor, with water passed through the tubing to carry off excess heat. The factors affecting the selection of conductors for the coil, and the solutions to the problems these factors present, are familiar to those skilled in the art of induction heating coil design and need not be recounted in detail here.

The electrical conductor 20 is wound on the spindle 12 of the coil former bobbin. The two ends of the continuous coil winding extend away from the wound coil former as electrical leads 22 for connection to an electrical power supply. The conductor windings may take the form of a large number of turns of small gauge conductor or a small number of turns of large gauge conductor. In most uses, the windings should substantially fill the area between the flanges 14, 16 on the spindle 12 of the bobbin.

Figure 3:
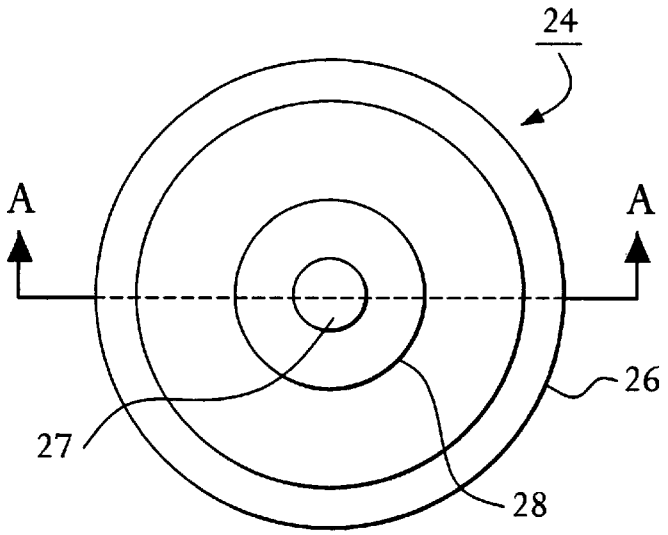
FIG. 3 is a top plan view of the magnetic field concentrator of the invention.
Figure 4:
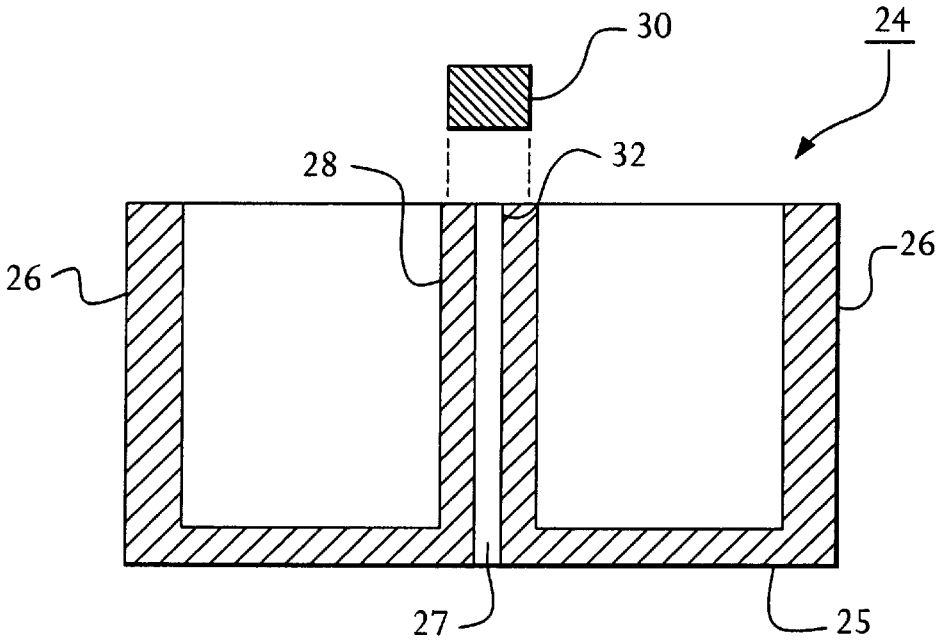
FIG. 4 is a cross-sectional view of the field concentrator of FIG. 3.

Referring to FIGS. 3 and 4, the invention further comprises a magnetic field concentrator 24. The field concentrator 24 comprises a base 25, a central core 28 and a side wall 26. The central core 28 may have an open channel 27 through it from the top 32 through the base 25. The field concentrator is substantially closed at the base 25 and the side wall 26, and is open at the top 32. A ferrite button 30 may be affixed to the top surface 32 of the central core 28 to exert influence on the magnetic field produced by the coil, drawing it inward toward the center of the assembly as the field extends out from the open portion of the magnetic field concentrator.

Figure 5:
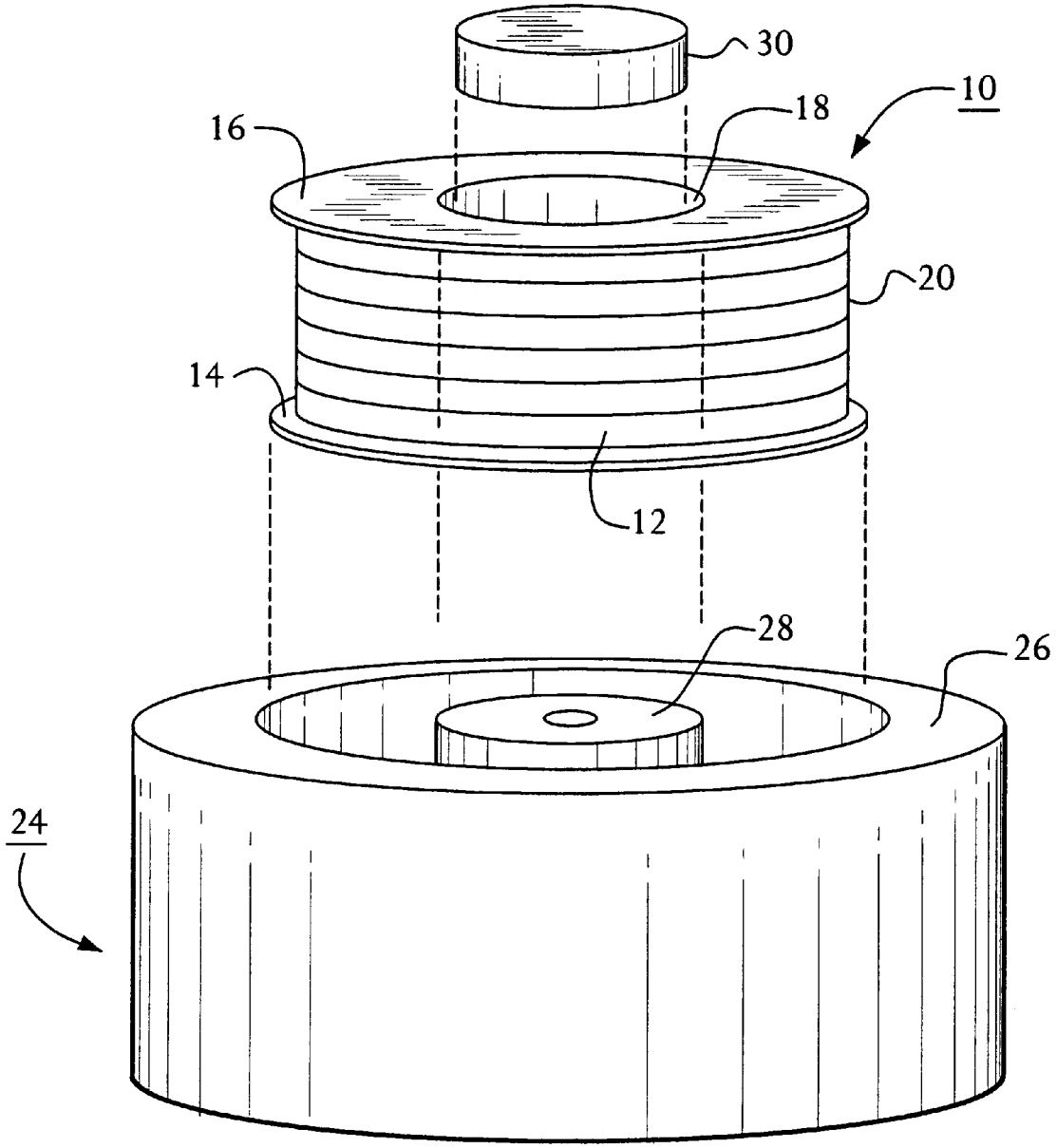
FIG. 5 is an assembly drawing of the induction coil assembly invention.

Referring to FIG. 5, the concentrator 24 is assembled with the wound bobbin 10. The bobbin 10 with the coil windings 20 is inserted into the field concentrator 24. The central core 28 of the field concentrator fits into the hollow bore 18 through the spindle 12 (shown in shadow) of the bobbin 10. One flange 14 of the bobbin 10 rests against the interior of the base 25 of the field concentrator 24 while the other flange 16 remains exposed at the open end of the concentrator. The side wall 26 of the concentrator surrounds the bobbin 10 and the coil windings 20. The ferrite button 30, if used, is affixed to the exposed surface of the central core 28 of the field concentrator 24. Once the bobbin and the field concentrator have been assembled together, the assembly may be potted for protection and durability.

The concentrator 24 is a material of high magnetic permeability that has far less resistance to magnetic field conduction than air. Ferrite materials are commonly employed for this purpose. Without encasement within the field concentrator, the magnetic field produced by the energized coil would emanate in all directions without restriction. The field concentrator acts to confine the magnetic field on all sides except on the exposed portion of the coil.

The magnetic permeability of a material is the ratio of the magnetic flux present in the material to the overall strength of the magnetic field. This relation can be expressed in the term:

$$m = B/H$$

where m is the magnetic permeability, B is the magnetic flux density, and H is the field strength. Assuming a fixed current in the heating coil, the maximum magnetic field strength does not change. With H fixed, it can be seen that a material with a high magnetic permeability m must have a high flux density B.

Figure 6:
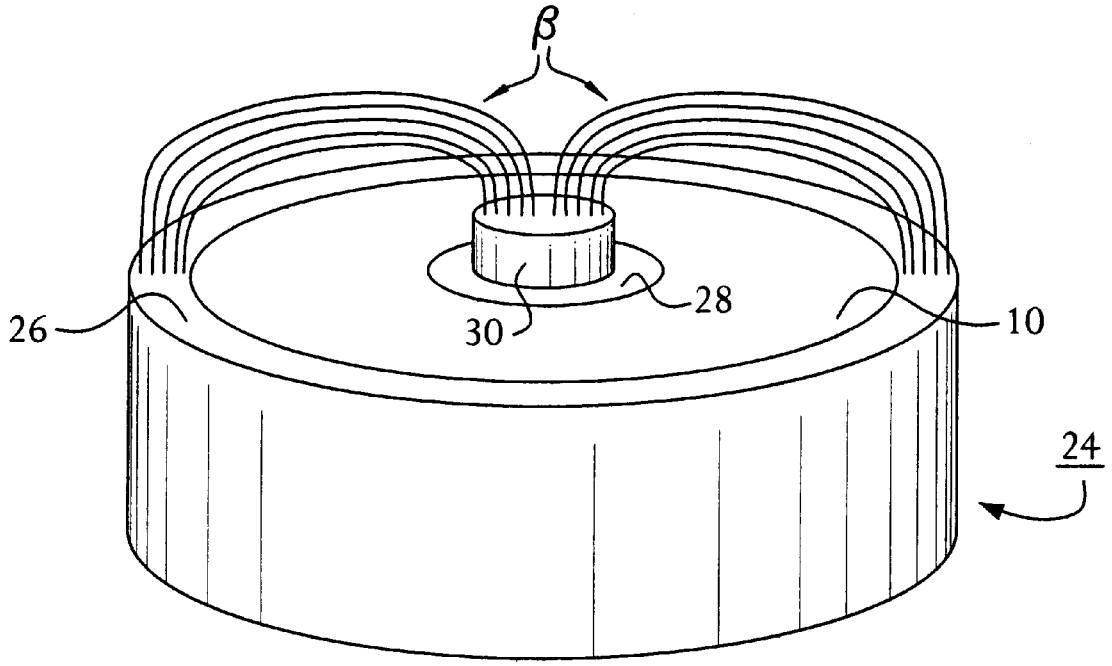
FIG. 6 is a two-dimensional schematic representation of the magnetic field produced by the coil assembly of the invention.

Referring to FIG. 6, the field concentrator's high magnetic permeability causes the magnetic flux produced by the coil to be confined within the concentrator's central core 28, base 25 (not shown) and side wall 26 with little significant magnetic flux emanating outside the field concentrator. Objects adjacent to the base 25 or side wall 26 of the coil assembly are shielded from the coil's induced flux.

Only on the exposed portion of the heating coil assembly is the magnetic flux B unconfined. The open portion of the coil is where the heating work occurs. In FIG. 6, the flux lines B are shown in only two dimensions for simplicity. The flux B is focused by the combination of influences exerted by the concentrator's central core 28 and the ferrite button 30. Thus, the induced magnetic flux B can focus on a target and heat it without simultaneously heating, and possibly damaging, adjacent elements.

Figure 7:
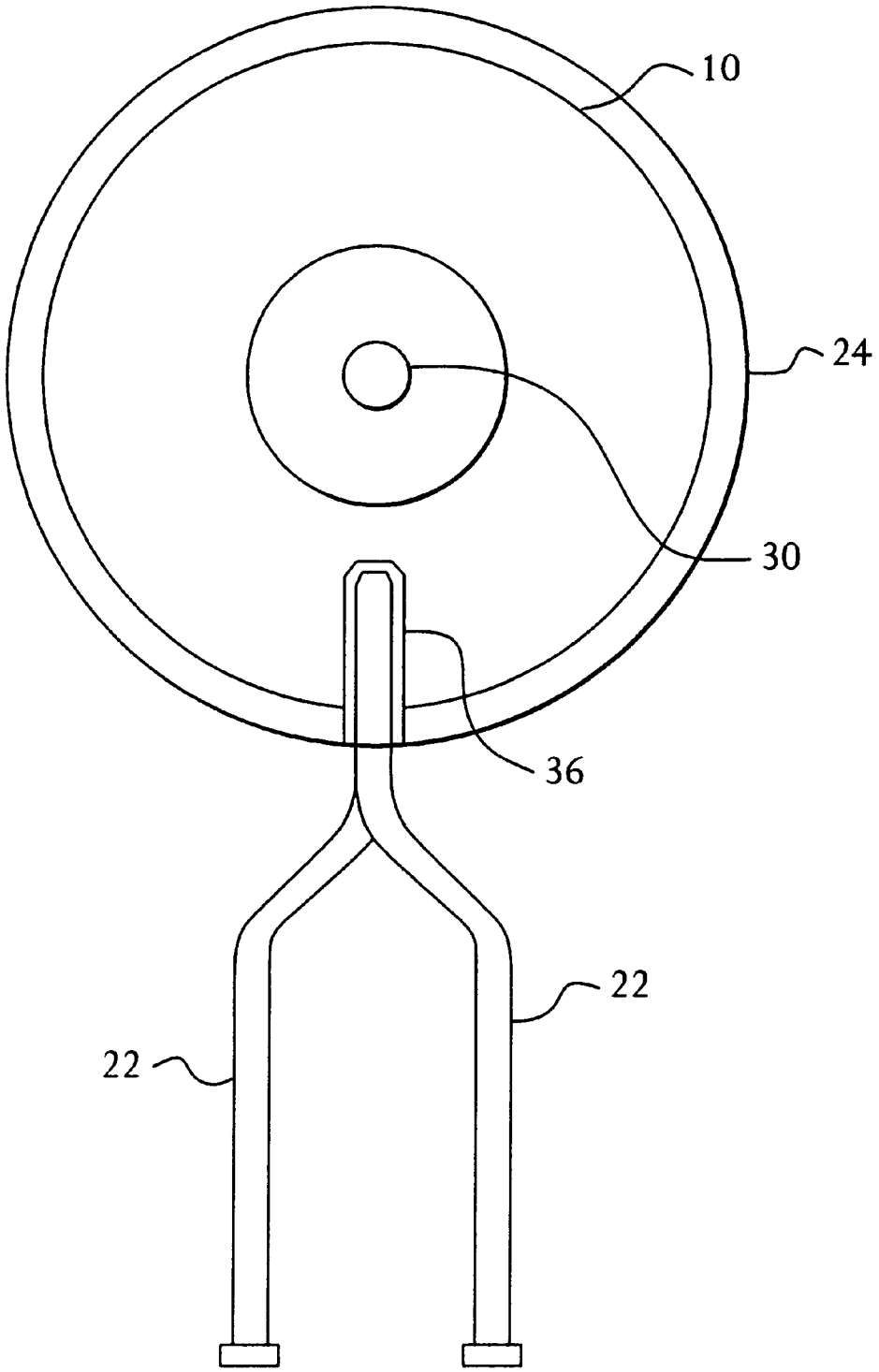
FIG. 7 is a plan view of an embodiment of the assembled invention.

Referring to FIG. 7, the heating coil assembly must be connected to a power supply for operation. The conductor leads 22, whether they comprise hollow tubing (as shown), or wire windings, must enter and leave the coil assembly. An aperture 36 in the bobbin provides an entry/exit point for the respective ends of the conductor leads 22. The conductor leads 22 can be connected to the power supply outside the coil assembly.

The heating coil of the present invention has such diverse uses as getter flashing in television picture tubes and epoxy curing of golf club shafts to heads. Typically, though not exclusively, the coil of the present invention is relatively small for use on small heating targets or for heating small areas of large parts.

In the getter flashing application, for example, the exposed portion of the coil is placed near or against the glass tube above the getter inside it and the magnetic field is directed inward towards the getter. Most of the magnetic energy is focused on the area occupied by the getter.

Two coils can be arranged to heat a specific area between them by facing the exposed coil portions toward each other with the heating target, such as a golf club shaft/head joint, between them. The target between the coils can be heated precisely and efficiently. Because of the shielding effect of the field concentrator, the coil can also be used in hand-held applications.

The overall efficiency of the coil is enhanced because no energy is dissipated heating elements other than the target. The focusing and shielding effects also allow multiple coils to be housed in close proximity without affecting the operation of any individual coil. Increased efficiency permits the coil to heat with less coil power, reducing the copper and coil losses in the coil.

The lower coil losses permit some applications to be realized without the necessity for internal coil cooling, such as by water flow or forced air. Thus some coils may comprise solid, stranded or Litz wire and greater copper area can be achieved. This also contributes to lower overall copper losses in the coil. The reduced coil losses and improved efficiency allow the use of smaller induction power supplies. Generally, coils constructed according to the present invention may be operated with smaller power supplies providing from 1–5 kW at frequencies from 50–450 kHz, though other power/frequency specifications may well be appropriate for certain applications of the coil invention.

The present invention may be embodied in other specific forms without departing from the spirit or essential attributes thereof and, accordingly, reference should be made to the appended claims, rather than to the foregoing specification, as indicating the scope of the invention.

I claim:

1. A getter heating coil assembly producing a focused magnetic field, comprising:

electrical conductors wound on a coil bobbin, said coil bobbin having a central spindle around which the conductors are wound;

said wound bobbin being assembled with a magnetic field concentrator, said field concentrator having a central core extending from a base, and also having a side wall extending from the base to enclose the wound bobbin, said central core of the field concentrator fitting within the spindle on the bobbin and extending through it, said side wall extending from the base a distance substantially equal to the extended core of the field concentrator, said coil bobbin remaining exposed on one side for emission of focused electromagnetic energy when alternating current is supplied to the coil windings.

2. The getter heating coil assembly of claim 1, further comprising a button of high magnetic permeability material attached to the magnetic field concentrator central core for focusing the emitted electromagnetic energy toward the center of the exposed side of the coil.

3. The getter heating coil assembly of claim 1 wherein the core and the side wall each have a free end located opposite the base and the coil bobbin further comprises an annular flange attached to the spindle adjacent the free end of the core and extending radially outward from the spindle, the flange having an outer periphery located adjacent the free end of the side wall.

4. An induction heating coil assembly producing a focused magnetic field, comprising:

electrical conductors wound on a coil bobbin, said coil bobbin having a central spindle around which the conductors are wound;

said wound bobbin being assembled with a magnetic field concentrator, said field concentrator having a central core extending from a base, and also having a side wall extending from the base to enclose the wound bobbin, said central core of the field concentrator fitting within the spindle on the bobbin and extending through it, said side wall extending from the base a distance substantially equal to the extended core of the field concentrator, said coil bobbin remaining exposed on one side for emission of focused electromagnetic energy when alternating current is supplied to the coil windings.

5. The induction heating coil assembly of claim 4, further comprising a button of high magnetic permeability material attached to the magnetic field concentrator central core for focusing the emitted electromagnetic energy toward the center of the exposed side of the coil.

6. The induction heating coil assembly of claim 4 wherein the core and the side wall each have a free end located opposite the base and the coil bobbin further comprises an annular flange attached to the spindle adjacent the free end of the core and extending radially outward from the spindle, the flange having an outer periphery located adjacent the free end of the side wall.

* * * * *